US006045205A

United States Patent [19]

Dingler

[11] Patent Number: 6,045,205

[45] Date of Patent: Apr. 4, 2000

[54] DISHWASHER WITH A TUB SUPPORT

[75] Inventor: Geoffrey L. Dingler, St. Joseph, Mich.

[73] Assignee: Whirlpool Corporation, Benton Harbor, Mich.

[21] Appl. No.: 08/987,846

[22] Filed: Dec. 9, 1997

Related U.S. Application Data

[60] Provisional application No. 60/036,104, Jan. 14, 1997.

[51] Int. Cl.[7] ..... A47B 91/00

[52] U.S. Cl. ..... 312/351.7; 312/228; 134/201

[58] Field of Search ..... 312/228, 332, 312/351.7; 248/676, 678, 188.91, 316.8, 188.8; 134/201

[56] References Cited

U.S. PATENT DOCUMENTS

| | | | |
|---|---|---|---|
| 3,811,746 | 5/1974 | Butsch et al. | 312/228 |
| 4,098,545 | 7/1978 | Gaiser et al. | 312/228 |
| 4,359,250 | 11/1982 | Jenkins | 312/228 |
| 4,746,177 | 5/1988 | Lampman et al. | 312/228 |
| 5,230,553 | 7/1993 | Tuller | 312/228 |

FOREIGN PATENT DOCUMENTS

| | | |
|---|---|---|
| 0452287 | 10/1991 | European Pat. Off. . |
| 1865993 | 11/1962 | Germany . |
| 2016637 | 10/1971 | Germany . |
| 3614345 | 9/1987 | Germany . |
| 3614389 | 9/1987 | Germany . |

*Primary Examiner*—Peter M. Cuomo
*Assistant Examiner*—Gerald Anderson
*Attorney, Agent, or Firm*—Andrea Powers Denklau; Thomas J. Roth; Robert O. Rice

[57] ABSTRACT

An automatic dishwasher comprising a metal wash tub mounted to a structural frame. The metal tub comprises multiple sides, which are welded together to form a weldment. The structural frame comprises a rear leg that is positioned beneath the bottom wall of the metal tub adjacent the weldment formed by the sidewall and the bottom wall. A retainer is mounted to the face of the leg and abuts the sidewall to mount the rear of the metal tub to the structural frame. The retainer conforms to the shape of the leg, weldment, and the sidewall to apply a clamping pressure thereto to clamp the weldment and the corner of the metal tub formed by the junction of the sidewall and the bottom wall between the retainer and the leg. The retainer and the leg have positioning means and alignment means to position and align the retainer relative to the leg for quick and easy assembly.

12 Claims, 4 Drawing Sheets

DISHWASHER WITH A TUB SUPPORT

This application claims the benefits of U.S. Provisional Application No. 60/036,104 filed Jan. 14, 1997.

BACKGROUND OF THE INVENTION

1. Field of the Invention

The invention relates to an automatic dishwasher; and, more particularly, to an automatic dishwasher with a tub support for a metal tub.

2. Description of the Related Art

Most contemporary automatic dishwashers comprise a plastic wash tub supported by a structural frame. The plastic wash tub has an open face, which is sealed by a door pivotally mounted to the structural frame. For economy, the plastic wash tub is normally molded as a single piece having a bottom wall, top wall, rear wall and opposing sidewalls. The plastic tub is also molded with a channel-shaped clip, located on the sidewalls near the junction of the sidewall, bottom wall and rear wall. The structural frame generally comprises a collar portion, which surrounds the open face of the tub, and a pair of rear legs. The collar and the rear legs are connected by various other structural members.

During the operation of the dishwasher, the wash tub is subjected to varying forces because of swirling water sprayed during the wash process. Also, the wash tub is subjected to forces from the loading of the dishracks, which are supported by the sidewalls of the wash tub. The collar generally provides sufficient mounting of the face of the tub to adequately support and stabilize the front portion of the tub. To stabilize the rear of the tub, the legs are adapted to be received within the clips molded in the lower rear corner of the wash tub. The combination of the collar and the molded-in channel-shaped clips generally provide adequate support and stability for automatic washers with plastic wash tubs.

However, the combination of the collar and the clips are not useable for a metal tub because the channel-shaped clips cannot be molded in the metal tub nor can they be stamped or formed in the metal tub. A potential solution would be to weld clips to the metal tub sidewalls, but welding is a relatively slow and expensive assembly technique and is avoided whenever possible, especially in high volume products such as dishwashers. Therefore, there is a need for a simple and quick solution to mounting a metal wash tub to the structural frame in a dishwasher when a metal tub is used.

SUMMARY OF THE INVENTION

The invention solves the problem associated with the unsuitability of plastic tub mounting techniques for metal tubs and provides a viable, simple and inexpensive mounting of the metal tub. The invention is a dishwasher comprising a metal tub having a bottom wall, a top wall, opposing sidewalls, and a rear wall, which define an open-faced chamber in which dishes and the like are received for washing. The dishwasher includes a structural frame for supporting the metal tub, including a leg abutting the bottom wall to support a portion of the metal tub. A retainer is mounted to the leg and abuts a sidewall to retain the metal tub to the structural frame. Preferably, the clamp applies a clamping force to the sidewall to help retain the metal tub.

In the preferred embodiment, the junction of the bottom wall and the sidewall forms a weldment. The leg is constructed with a platform that supports the bottom wall and which is positioned behind the weldment. The leg has a face to which the retainer is mounted. The retainer conforms to the shape of the sidewall. The weldment is pinched between the leg and the retainer to mount the tub to the structural frame. Also, the sidewall can have an inwardly sloping portion near the weldment and the retainer conforms to the shape of the inwardly sloping portion so that the clamping force of the retainer tends to hold the tub between the retainer and the leg.

To ease assembly of the automatic dishwasher, the leg can have a positioning aperture and the retainer can have a positioning tab, which is inserted into the positioning aperture to position the retainer relative to the leg during assembly. Additionally, the leg can have an alignment key and a pilot aperture and the retainer can have a corresponding alignment guide and a fastener aperture. When the alignment key is received within the alignment guide, the fastener aperture is aligned with the pilot aperture and a fastener can be inserted through the fastener aperture and into the pilot aperture to mount the retainer to the leg.

DESCRIPTION OF THE PREFERRED EMBODIMENT

Figure 1:
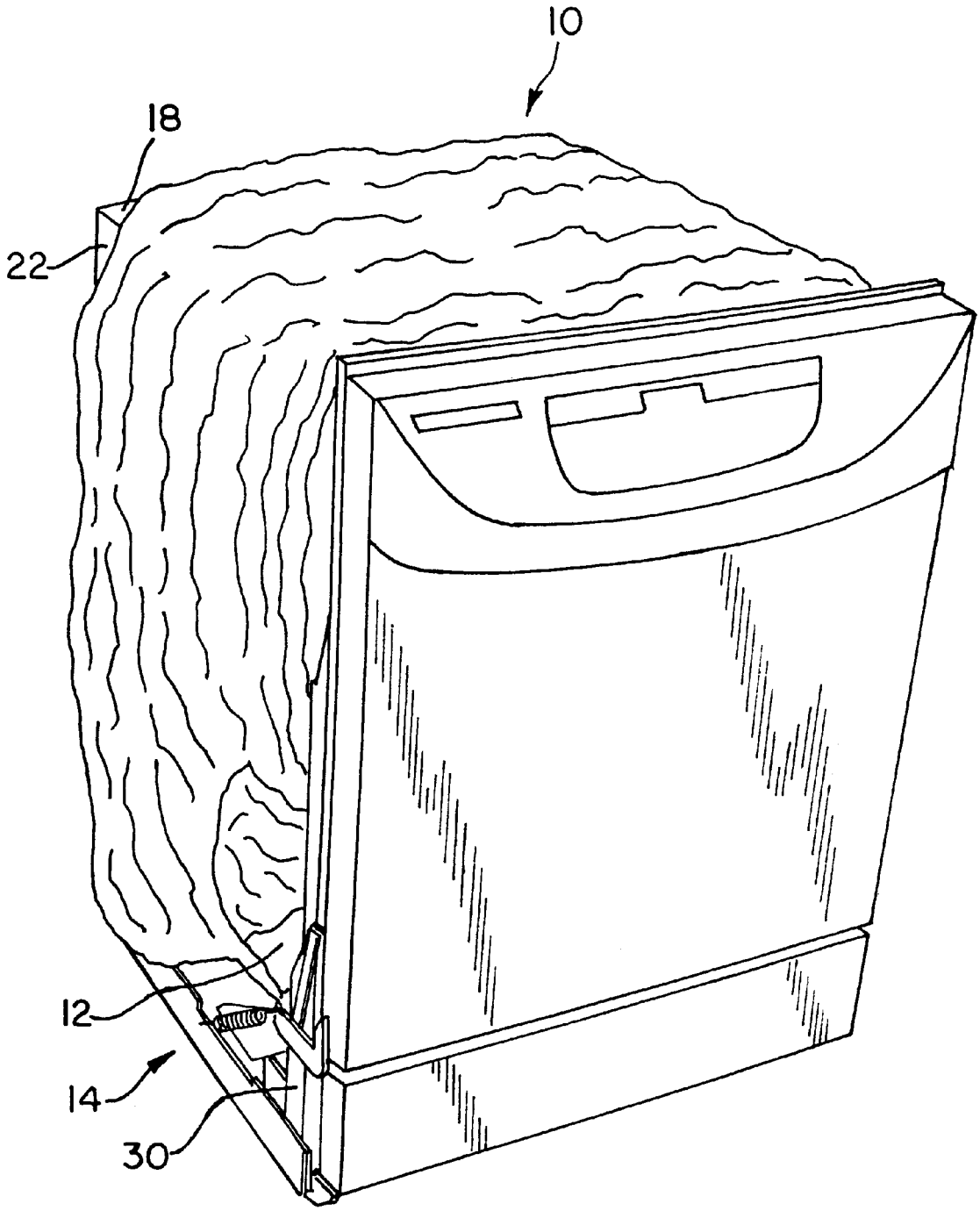
FIG. 1 is a front perspective view of an automatic dishwasher according to the invention.

FIG. 1 illustrates an automatic dishwasher 10 according to the invention. The dishwasher 10 as illustrated is a built-in type and does not have an outer cabinet. A sound absorbing material and a door have been removed for clarity in FIGS. 2–5. The invention is not limited to built-in dishwashers and can be used in many different types of dishwashers.

Figure 2:
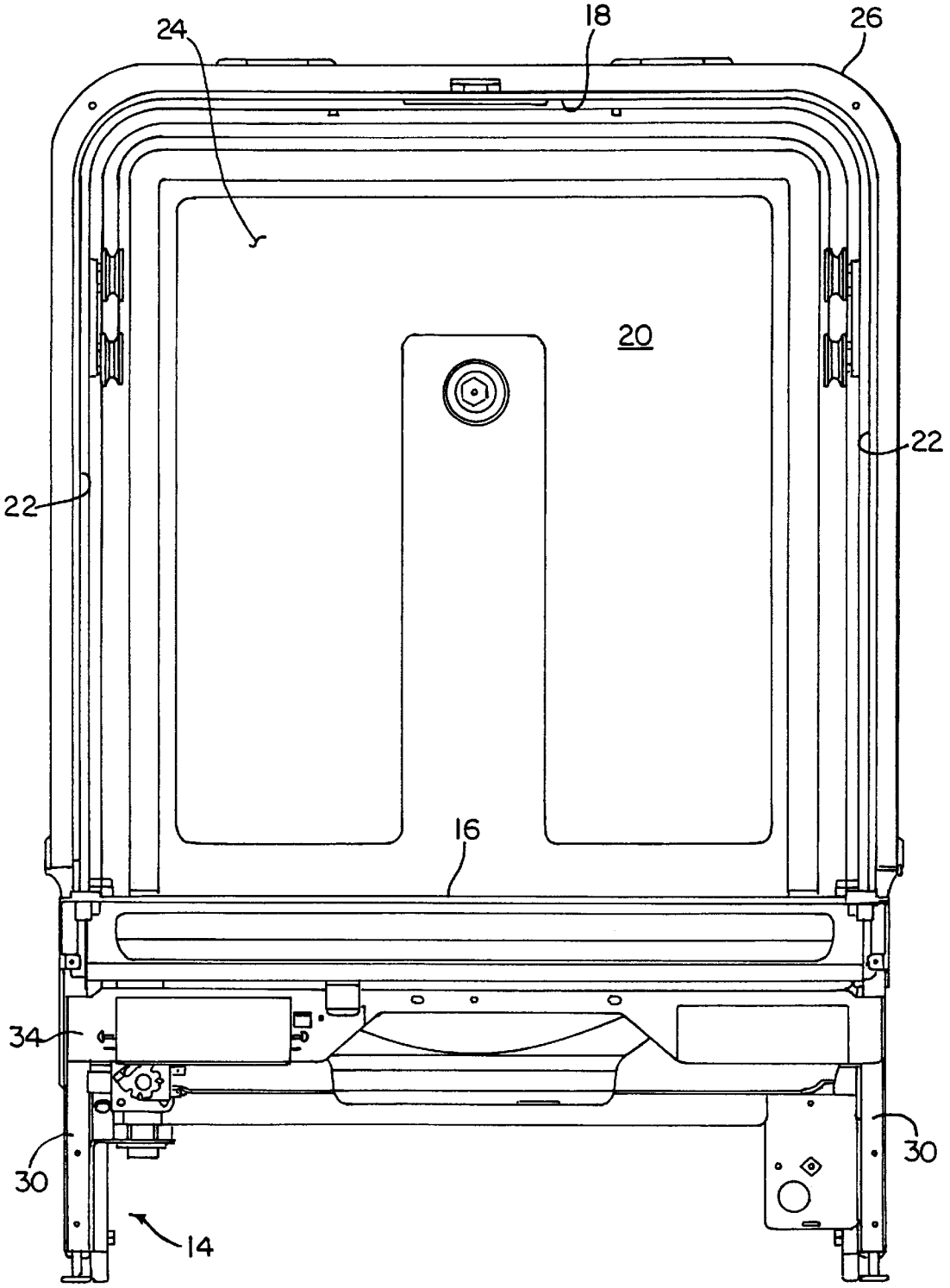
FIG. 2 is a front view of the automatic dishwasher of FIG. 1 with the door and the sound absorbing material removed for clarity.
Figure 3:
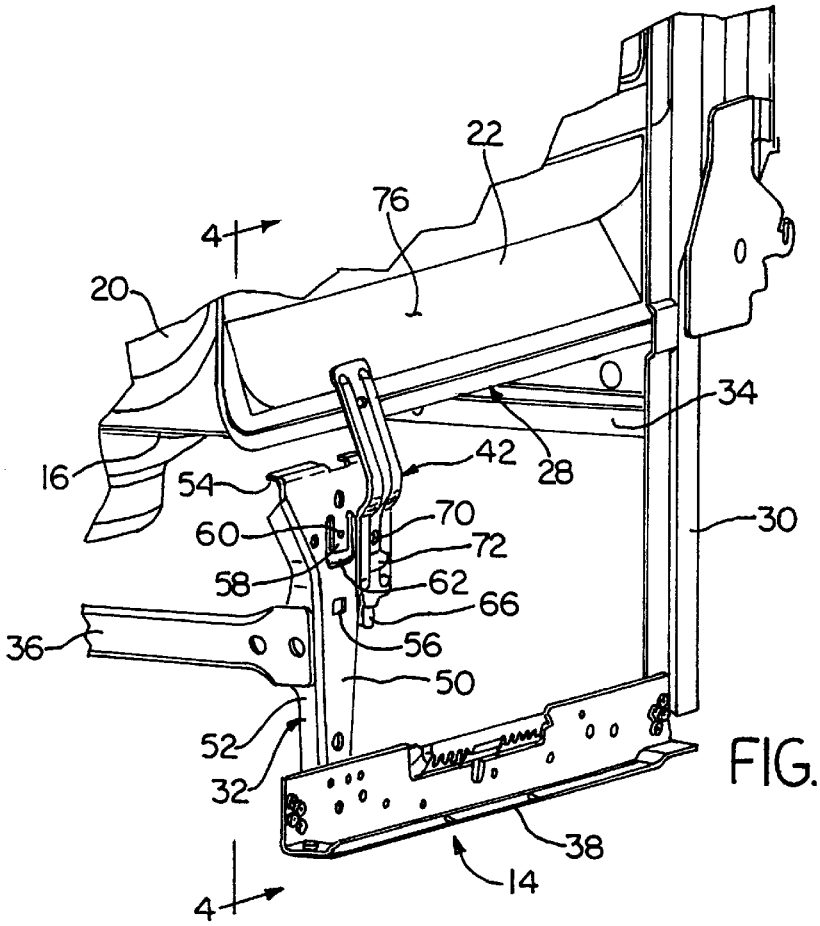
FIG. 3 is an exploded view of the lower rear portion of the dishwasher of FIG. 1 with the sound absorbing material removed for clarity.

Referring to FIGS. 1–3, the dishwasher 10 comprises a metal tub 12 and a structural frame 14 on which the metal tub 12 is supported to stabilize any movement of the metal tub 12 associated with the operation of the dishwasher 10, such as the effects of water sprayed within the dishwasher 10 or the loading of the wash baskets (not shown), which mount to the metal tub 12.

The metal tub 12 comprises a bottom wall 16, a top wall 18, a rear wall 20, and opposed sidewalls 22, which define an open face 24 having a circumferential flange 26. The metal tub 12 is preferably made from stainless steel. To form the metal tub 12, each of the junctions of each of the walls is welded together to form a weldment 28 (FIGS. 3, 4 and 5).

The structural frame 14 comprises front legs 30 and rear legs 32. The front legs 30 are connected by a front brace 34 and the rear legs 32 are connected by a rear brace 36. Each of the front legs 30 is connected to a rear leg 32 by a side rail 38. A collar 40 extends from the front brace 34 and couples with the circumferential flange 26 to mount the open face 24 of the metal tub 12 to the structural frame 14 in a well known manner. The rear of the metal tub 12 is supported by rear legs 32, which are positioned so a portion of the rear legs 32 abuts the bottom wall 16, and a retainer 42, which is mounted to the rear leg 32 and shaped to conform to the sidewall 22. Preferably, the retainer 42 applies a clamping force to the sidewall 22 to help mount the rear of the metal tub 12 to the structural frame 14.

Figure 4:
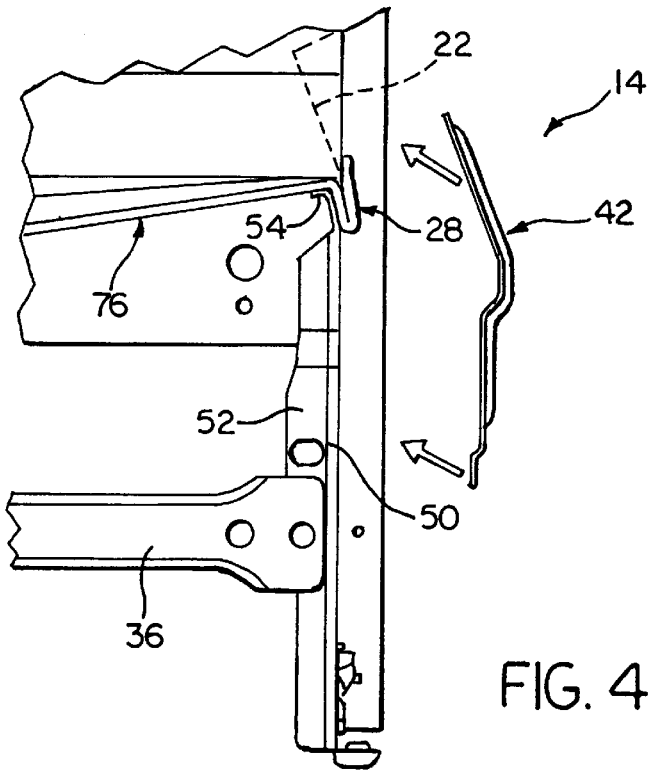
FIG. 4 is a sectional view of FIG. 3 taken along line 4—4.
Figure 5:
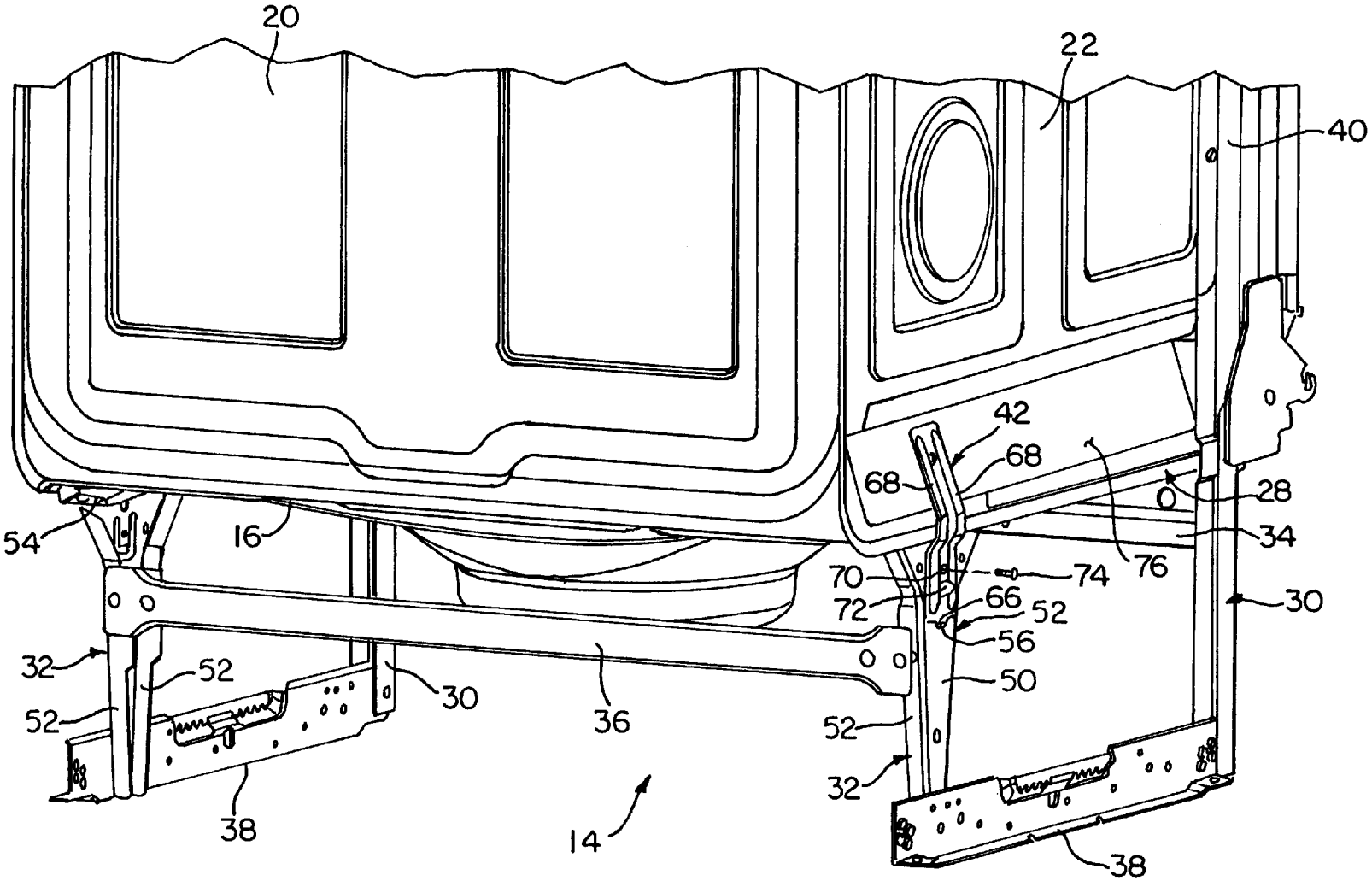
FIG. 5 is an assembled view of FIG. 3.

FIGS. 3 and 4 illustrate in greater detail the mounting of the rear of the metal tub 12 to the structural frame 14. Although a pair of rear legs and their corresponding retainers are shown in the drawings, only one will be described with it being understood that the description applies to both rear leg and retainer combination. As can be seen in FIGS. 2 and 3, the rear legs 32 are made from a sheet material that is formed or stamped to define a face 50 from which extends sides 52 and a flange 54. Flange 54 functions as a support platform for supporting the bottom wall 16 of the metal tub 12. A positioning aperture 56 and a tang 58 are formed in the face 50. The tang 58 has a pilot aperture 60 formed in the body of the tang 58 and an alignment key 62 at the terminal end of the tang 58.

The retainer 42 comprises a generally rectangular planar body having a positioning tab 66 extending from a lower end of the retainer 42. A pair of stiffening ribs 68 run parallel to each other and extend along the longitudinal axis of the retainer 42. A fastener aperture 70 is provided in the body of the retainer 42 between the stiffening ribs 68. An alignment guide 72 is provided between the stiffening ribs 68 and below the fastener aperture 70.

Referring to FIGS. 3–5, the rear of the metal tub 12 is mounted to the structural frame 14 by positioning the rear legs 32 so that the flange 54 of the rear legs 32 abuts the lower surface of the bottom wall 16 and behind the weldment 28. The retainer 42 is then mounted to the rear leg 32 and secured by any suitable fastener 74 passing through the fastener aperture 70 and the pilot aperture 60.

The task of quickly and simply mounting the retainer 42 to the rear leg 32 is accomplished by the structure of the leg and retainer. First, the positioning tab 66 is placed within the positioning aperture 56 to generally position the retainer 42 relative to the rear leg 32. Second, the retainer 42 is rotated toward the rear leg 32 until the alignment key 62 is received within the alignment guide 72 to align the pilot aperture 60 with the fastener aperture 70. The fastener 74 is then inserted through the fastener aperture 70 and into the pilot aperture 60 where it is tightened to mount the retainer 42 to the rear leg 32.

Preferably, there is a layer of mastic 76 positioned between the sidewall 22 and the retainer 42 and the bottom wall 16 and the flange 54 of the rear leg 32. The mastic helps to deaden any sound that otherwise would result if there was direct contact between the rear leg 32 and retainer 42 and the bottom wall 16 and sidewall 22 respectively.

As is best seen in FIG. 4, the cross section of the retainer 42 generally conforms to the shape of not only the sidewall 22 as previously stated but it also conforms to the face 50 of the rear leg 32 and to the weldment 28. It is preferred that the cross section of the retainer 42 be slightly bowed or the portion abutting the sidewall 22 be slightly bent in so that when the fastener 74 is tightened, the retainer 42 is drawn in tightly against the sidewall 22 to apply a clamping force to the sidewall 22. Also, the upper portion of the face 50 conforms to the shape of the weldment 28.

The advantage of the shapes of the retainer 42 and the rear leg 32 is that the weldment 28 is essentially pinched between the retainer 42 and the rear leg 32 because they contact opposite sides of the weldment 28. Another advantage arises in that the lower portion of the sidewall 22 angles inwardly and the clamping force applied by the retainer 42 tends to clamp the lower portion of the metal tub 12 formed by the junction of the bottom wall 16 and sidewall 22 between the flange 54 of the rear leg 32 and the retainer 42.

The combination of the rear leg 32 and the retainer 42 permit the rear portion of the metal tub 12 to be secured to the structural frame 14 without the extra cost and aesthetically displeasing appearance of welding a clip to the metal tub 12. Additionally, the retainer 42 is quickly and simply mounted to the rear leg 32 because of the positioning and alignment features of the rear leg 32 and the retainer 42. The reduced cost of the mounting and its simplicity is an improvement over previous dishwashers and solves the problems encountered when using a metal tub.

We claim:

1. A dishwasher comprising:

a metal tub having a bottom wall, a top wall, opposing side walls, and a rear wall, which define an open-faced chamber adapted to receive dishes for washing;

a structural frame for supporting the metal tub and having a leg abutting the bottom wall for supporting a portion of the metal tub;

a retainer mounted to the leg and in contact with one of the metal tub walls to retain the metal tub to the structural frame; and said leg has an alignment key and a pilot aperture, the retainer has an alignment guide and a fastener aperture, and the alignment guide is adapted to receive the alignment key to align the fastener aperture and the pilot aperture to permit a fastener to pass through the fastener aperture and into the pilot aperture to mount the retainer to the leg.

2. A dishwasher comprising:

a metal tub having a bottom wall, a top wall, opposing side walls, and a rear wall, which define an open-faced chamber adapted to receive dishes for washing;

a structural frame for supporting the metal tub and having a leg for supporting a portion of the metal tub;

a clamp mounted to the leg and in contact with and applying a clamping force to one of the metal tub walls to retain the metal tub to the structural frame; and the bottom wall and the side wall abut to form a junction and said junction forms a generally downwardly extending weldment, the leg has a platform on which the bottom wall is supported and which is positioned behind the weldment, and the leg has a face and the clamp is mounted to the face of the leg and is shaped to conform to the sidewall to apply a clamping force against the sidewall to retain the metal tub in a substantially fixed position.

3. A dishwasher comprising:

a metal tub having a bottom wall, a top wall, opposing side walls, and a rear wall, which define an open-faced chamber adapted to receive dishes for washing;

a structural frame for supporting the metal tub and having a leg abutting the bottom wall for supporting a portion of the metal tub;

a retainer mounted to the leg and in contact with one of the metal tub walls to retain the metal tub to the structural frame;

the bottom wall and the side wall abut to form a junction and said junction forms a generally downwardly extending weldment and the leg has a platform on which the bottom wall is supported and which is positioned behind the weldment; and the leg has a face and the retainer is mounted to the face of the leg and is shaped to conform to the sidewall to retain the metal tub in a substantially fixed position.

4. The dishwasher as claimed in claim 3, wherein the leg has a positioning aperture and the retainer has a positioning tab adapted to be received within the positioning aperture to position the retainer relative to the leg.

5. The dishwasher as claimed in claim 4, wherein the leg has an alignment key and a pilot aperture, the retainer has an alignment guide and a fastener aperture, and the alignment guide is adapted to receive the alignment key to align the fastener aperture and the pilot aperture to permit a fastener to pass through the fastener aperture and into the pilot aperture to mount the retainer to the leg.

6. The dishwasher as claimed in claim 5, wherein the leg has a planar face in which is formed a tang, the tang has an aperture defining the pilot aperture and a rib defining the alignment key.

7. The dishwasher as claimed in claim 6, wherein the leg has a flange extending away from a top portion of the face to define the platform.

8. The dishwasher as claimed in claim 4, wherein the retainer is an elongated plate having at least one longitudinally extending stiffening rib.

9. The dishwasher as claimed in claim 8, wherein the retainer has a transversely extending rib defining the alignment guide.

10. A dishwasher comprising:

a metal tub having a bottom wall, a top wall, opposing side walls, and a rear wall, which define an open-faced chamber adapted to receive dishes for washing;

a structural frame for supporting the metal tub and having a leg for supporting a portion of the metal tub;

a clamp mounted to the leg and in contact with and applying a clamping force to one of the metal tub walls to retain the metal tub to the structural frame; and the leg has an alignment key and a pilot aperture, the clamp has an alignment guide and a fastener aperture, and the alignment guide is adapted to receive the alignment key to align the fastener aperture and the pilot aperture to permit a fastener to pass through the fastener aperture and into the pilot aperture to mount the clamp to the leg.

11. The dishwasher as claimed in claim 10, wherein the clamp is an elongated plate having at least one longitudinally extending stiffening rib.

12. The dishwasher as claimed in claim 10, wherein the clamp has a transversely extending rib defining the alignment guide.

* * * * *